United States Patent [19]

Daulton

[11] 4,253,664

[45] Mar. 3, 1981

[54] TENNIS SERVE TRAINING DEVICE

[76] Inventor: Everett Daulton, 7717 Keswick, Powell, Tenn. 37849

[21] Appl. No.: 935,691

[22] Filed: Aug. 25, 1978

[51] Int. Cl.[3] ..... A63B 69/38

[52] U.S. Cl. ..... 273/29 A

[58] Field of Search ..... 273/29 R, 26 E, 95 A, 273/29 A, 97 R, 58 C; 150/2.5, 12, 11; 272/67

[56] References Cited

U.S. PATENT DOCUMENTS 3,845,953 11/1974 Malhas ..... 273/29 A 3,997,159 12/1976 Malhas ..... 273/29 A

*Primary Examiner*—Richard C. Pinkham

*Assistant Examiner*—T. Brown

*Attorney, Agent, or Firm*—Luedeka & Fitch

[57] ABSTRACT

A tennis serve training device is provided which includes an elongated rigid handle adapted to being gripped as a tennis racquet is gripped. The handle includes a first end and a second end portion. A pair of elongated flexible pouches are secured directly to the second end portion. Each pouch is adapted to receive at least one tennis ball.

3 Claims, 6 Drawing Figures

TENNIS SERVE TRAINING DEVICE

The present invention relates generally to the area of practice devices for improving a user's technique of playing tennis. More particularly, it relates to a device for the indication and correction of improper motion in the course of a tennis serve.

It is generally recognized among tennis players and instructors that the most important stroke to master is the serve. It is the serve which most frequently sets the pace for the game and often determines who will win the point. At the same time, however, the serve is probably the most difficult stroke to master. Although the server controls where the ball will be, as well as its speed and direction of motion, the service area, the "target", is only about one quarter of the opponent's court area and the net further reduces the "effective" service area.

There are many types of service errors committed by tennis players. Some very common areas of difficulty involve improper approach to the ball, twisting the racket and lack of follow-through. These errors cause various undesirable results including misdirection of the ball and diminished power in the serve. Consequently, tennis players and instructors spend large amounts of time and effort to overcome these errors.

Unfortunately, without a videotape machine, for example, it is frequently difficult for the instructor to detect the player's errors. It is even more difficult for the player himself to discover the errors and then force himself to correct them. Various efforts have been made to provide a device which has the characteristics of a tennis racquet in motion, and yet which permits the user to discover his errors and which also aids in the correction of the errors. For example, in U.S. Pat. No. 3,997,159 there is disclosed a device in which a pouch, adapted to receive a plurality of tennis balls, is attached to one end of a rope-like tether. The other end of the rope is formed in a loop which is placed around the user's wrist. If a plurality of such devices are used, a ring may be placed around the tethers to bind them into a single rope-like tether. U.S. Pat. No. 3,845,953 discloses another device comprising a pouch and a rope-like tether to which a rigid tubular handle is secured. If a plurality of pouches are to be used, the tether from each one is passed through the tubular rigid handle and then secured to the outer portion of the handle or the user's wrist.

Neither of these prior devices have satisfactorily imitated the wind resistance characteristics of a tennis racquet. A tennis racquet includes substantial wind-resisting area between the gripping portion of the handle and the head of the racquet, particularly in those racquets which do not have an open throat. The rope-like tethers of the prior devices do not provide a corresponding wind resistance in the area between the gripped area and the pouches. Instead, the wind resistance effect is concentrated in an area spaced from the handle.

Also, while these prior devices adequately indicate errors in the overall direction of the service motion, they do not adequately indicate or correct rotational errors caused by twisting the handle. The rope-like tethers do not provide sufficient resistance to discourage twisting nor is the user adequately notified when the pouches have rotated out of their proper positions.

It is therefore an object of the present invention to provide a training device which indicates errors of motion in the course of a tennis serve, including both directional and rotational errors. It is also an object to provide a training device which simulates the feeling of a tennis racquet, including the wind resistance, in the course of a tennis serve. It is a further object to provide a training device which aids in the correction of errors in a tennis serve when used in place of a tennis racquet. Further objects and advantages will become apparent by reference to the following description and accompanying drawings.

Figure 3:
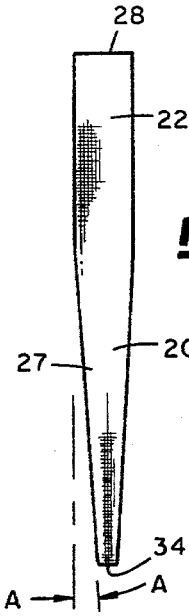
FIG. 3 is a plan view of a pouch which comprises a portion of the device illustrated in FIG. 1.
Figure 1:
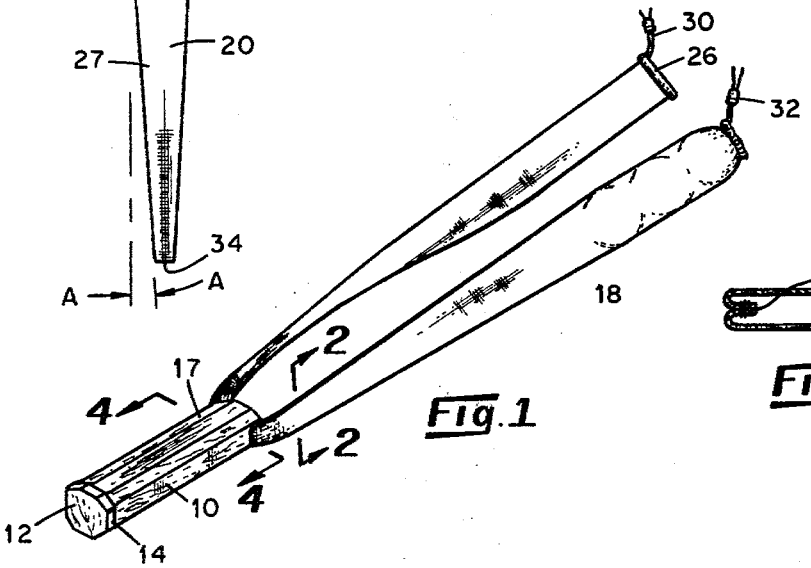
FIG. 1 is a perspective view of a tennis serve training device embodying various of the features of the present invention.
Figure 2:
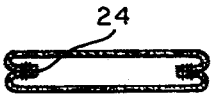
FIG. 2 is a cross-sectional view taken along line 2—2 in FIG. 1.

A device in accordance with the present invention comprises a rigid, elongated handle 10 which may be composed of wood, plastic or light metal and which is adapted for gripping in the same manner that a tennis racquet is gripped. The handle 10 is preferably shaped like a tennis racquet handle, having a cross-section which is generally octagonal in shape, about 0.5 inch per side, and having a length of about 6 to 7 inches. A first end 12 of the handle 10 is expanded to form a ridge 14 which prevents the handle from slipping out of a user's grip. Opposite from the first end 12 is the handle second end 17.

A pair of identical, elongated, flexible pouches 18 are secured directly to the handle 10. Each of the pouches 18 includes a first section 20 secured directly to the handle second end portion 17 and a second section 22 adapted to receive at least one tennis ball. The overall length of the handle and pouches is approximately that of a normal tennis racquet, i.e. about 26 inches.

In a preferred embodiment each pouch is formed from a single symmetrical piece of fabric which is folded over its center line and sewn along both sides to form a single tube having a first section 20 shaped generally like a frustrum or cone and a second section 22 which is cylindrical. The first section 20 is about 11 inches in length, about 2.75 inches in diameter where it joins the second section 22, and tapers to about 0.75 inches in width at the narrow end 34. The tapering wall 27 forms an angle A of about 10° with the axis of the pouch. The resulting tube is reversed on itself to locate the seam allowance 24 on the inside of the tube and provide a smooth exterior surface on the pouch. Thereafter a hem 26 is formed in the wide end 28 of the tube for insertion of a drawstring 30. A securing clip 32, such as that disclosed in U.S. Pat. No. 3,564,670, is mounted on each drawstring 30 to releasably close the wide end 28 of each pouch 18 after a ball or balls are inserted.

Figure 4:
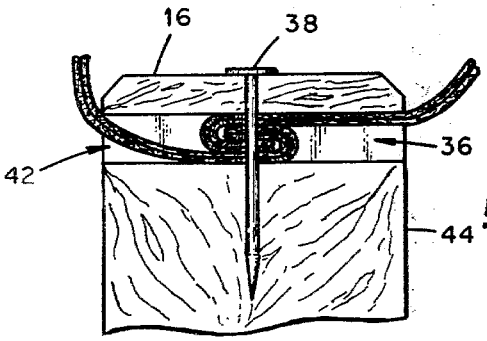
FIG. 4 is a partial cross-sectional view taken along line 4—4 in FIG. 1.

The first sections 20 of the pouches 18 are secured to the second end portion 17 of the handle 10 in any of a variety of manners. For example, a generally planar slot 36, perpendicular to the axis of the handle and having elongated openings 42 on opposing sides of the handle, is defined in the second end portion 17 of the handle. In order to secure the pouches 18 as shown in FIG. 4, the narrow end 34 of one pouch 18 is inserted completely through the planar slot 36, then the narrow ends 34 of the two pouches are folded on one another in a "hooked" fashion. The "hooked" ends are then reinserted into the slot 36 and a nail 38 is inserted along the axis of the handle, passing through the "hooked" ends, preventing their removal from the slot.

Figure 5:
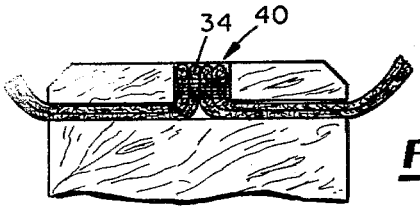
FIG. 5 is a partial cross-sectional view of an alternative embodiment of the device shown in FIG. 4.

Alternatively, as shown in FIG. 5, an axial passageway 40 is formed in the handle 10 generally perpendicular to the slot 36. The narrow end 34 of each pouch is inserted through an opposing opening 42 of the slot 36 and then through the passageway 40 until both narrow ends 34 extend from the handle. The narrow ends are then stitched or otherwise secured to one another to form a bundle which is incapable of passing through the slot 36.

Although the first section 20 of each pouch 18 may be attached directly to the exterior surface 44 of the handle such as with nails or staples, it is preferred to attach the pouches within a slot. In this manner, the direct pressure applied to the attaching means is reduced, thus prolonging the life of the device.

In preparation for use, from one to five tennis balls are inserted into each pouch through the wide end 28 of the second section 22, the same number of balls being placed in each pouch. The drawstring 30 is then tightened and secured with the fastener 32, preventing the balls from leaving the pouch. The drawstring and the fastener are inserted through the tightened end of each respective bag to prevent injury to the user as he swings the training device.

In use, the user grasps the handle 10 just as a tennis racquet is gripped and attempts to perform the standard tennis serve motion. Upon completion of the follow-through, the momentum of the pouches 18 causes them to travel down across the front of the user's body and then upwardly along the outside of the body on the side opposite the serving arm. In a smooth flowing motion the pouches continue through the top of an arc to return to the starting position. In this manner a continuous swinging motion may be maintained, permitting the effect of up to twenty-five serves per minute. If the service motion is performed essentially correctly, the device performs as a warm-up device and reinforces the proper motion for the tennis serve.

If the user does not perform the correct motion for a tennis serve, the device performs in a manner which both forces the user to correct some errors and indicates other errors. For example, the momentum of the pouches, weighted with tennis balls, forces the user to extend fully as he reaches upwardly to the point where he would strike a tossed ball. This momentum also forces the user to perform a full, smooth follow-through.

If the pouches do not remain fully extended in the course of the swing, this indicates to the user that he is not using a smooth continuous swing. Instead, he is hesitating at some point, probably in his approach to the ball. If the device seems to pull the user forward and off balance, the user is probably reaching forward rather than upwardly.

If the user does not correctly arch his back as he swings the device behind his back, the pouches strike his back.

If the pouches strike the user's ball toss arm in the course of the follow-through, the user is not properly pivoting his body as the serve is completed.

A fairly common error committed during the course of a tennis serve is twisting the racquet. The present invention discourages such motion and clearly indicates to the user when such errors are committed. The pair of weighted pouches 18 naturally travel in parallel arcs as long as the handle 10 is not rotated. However, if the user causes the handle to rotate, this force is applied directly to the weighted pouches. When the weighted pouches are swinging, the pouches are stretched, maintaining an expanded condition, which is semi-rigid. The second section 22 of the pouch 18 is maintained essentially circular in cross-section by the tennis ball(s) contained therein. The pouch first section 20, which is circular in cross-section where it joins the second section 22, progressively flattens in cross-section as it approaches the handle 10. At the handle, each pouch second section is essentially linear in cross-section, contacting the exterior 44 of the handle 10 along a line. These lines of contact are parallel and spaced apart by the thickness of the handle, preferably at least about one inch. The length of linear contact is preferably about 0.75 inch.

The stretching effect causes each pouch to move as a rigid body rather than absorbing small twisting forces. The linear contact arrangement forces the pouches and handle to rotate as a unit. Unlike the rope-type tether devices, the handle cannot rotate without essentially immediately drawing the pouches into the same rotation. However, a rather substantial twisting force is required in order to overcome the inertia of the weighted swinging pouches and force them out of their parallel paths. Therefore, as the user unconsciously twists the handle, the inertia of the weighted pouches immediately applies a counter force, correcting the error. If sufficient twisting force is applied by the user to overcome the inertia of the weighted pouches, the pouches will rotate. This rotation of the weighted pouches is in turn applied directly to the handle when the user ceases to apply a rotational force. Thus, the user is "told" immediately that he has twisted the handle and knows that he should seek to correct this problem.

Figure 6:
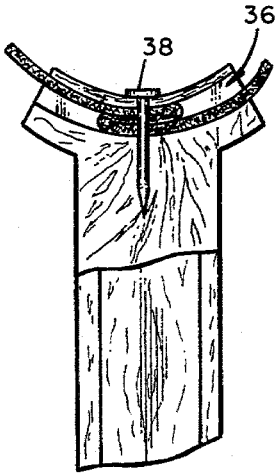
FIG. 6 is a partial cross-sectional view of another alternative embodiment of the device shown in FIG. 4.

The immediate rotational effects are amplified by the spacing of the outlets of the slot. In a preferred embodiment the outlets 42 are parallel and spaced apart by a distance of at least about 1 inch. As shown in FIG. 6, the rotational effect may be further magnified by expanding the second end 16, giving the handle a Y-shaped appearance, and correspondingly increasing the length of the slot 36.

Employing the present invention, a training device is provided for the training of the tennis serve. The device has the length and wind resistance characteristics of a tennis racquet. When it is swung in the manner of a tennis serve, it corrects and notifies the user of errors, including both directional and rotational errors.

While a preferred embodiment has been described herein, various modifications and improvements may be apparent to one skilled in the art. There is, however, no intention to limit the invention except as set forth in the following claims.

What is claimed is:

1. A tennis serve training device comprising an elongated rigid handle, adapted to being gripped in the manner in which a tennis racquet is gripped, and including a first end and a second end portion opposite said first end, said second end portion including a planar slot oriented generally perpendicular to the axis of said handle and having outlets on each of two opposing sides of said handle, and a pair of elongated flexible pouches, each of said pouches including a first second secured directly to said second end portion of said handle at a point within said slot and each pouch passing outwardly through one of said slot openings.

2. A device as defined in claim 1 wherein said slot outlets are parallel and spaced apart by a distance of at least about 2 inches.

3. A device in accordance with claim 1 wherein each of said pouch first sections linearly contacts the exterior of said handle.

* * * * *